United States Patent [19]

Baehr

[11] Patent Number: 5,054,129

[45] Date of Patent: Oct. 8, 1991

[54] HOSIERY GARMENT WITH OPEN-TOE, OPEN CROTCH STRUCTURE

[76] Inventor: Elsa Baehr, 8911 Ewing Ave., Evanston, Ill. 60203

[21] Appl. No.: 577,298

[22] Filed: Sep. 4, 1990

[51] Int. Cl.[5] ..... A41B 11/04

[52] U.S. Cl. ..... 2/409; 2/239; 2/242; 128/165; 128/159

[58] Field of Search ..... 2/409, 239, 22, 23, 2/24, 240, 242; 128/165, 159, 132

[56] References Cited

U.S. PATENT DOCUMENTS

| | | | |
|---|---|---|---|
| 1,435,047 | 11/1922 | Blum | 2/242 |
| 4,156,294 | 5/1979 | Horn | 2/409 |
| 4,351,068 | 9/1982 | Taylor | 2/409 |
| 4,424,596 | 1/1984 | Jackson | 2/409 |

*Primary Examiner*—Werner H. Schroeder
*Assistant Examiner*—Gloria Hale

[57] ABSTRACT

An open toed, ventilated crotch, panty hose garment, adapted for wear with swimsuits, exercise and dance clothing, and for post surgical wear that entirely covers the lower body down to an edge that encircles the foot near the base of the toes and defines an opening through which the toes protrude. The upper and lower portions of the edge being bridged between the first and second toes, and also between the fourth and fifth toes by straps which create a double thong effect and provide a means to distribute the securing load for comfort, permittting the wearer to maintain the foot portion in position and keep the pantyhose taut on the body, even when wet. The garment may also be modified for post surgical wear.

14 Claims, 2 Drawing Sheets

HOSIERY GARMENT WITH OPEN-TOE, OPEN CROTCH STRUCTURE

TECHNICAL FIELD OF THE INVENTION

The present invention relates to knit garments and more particularly relates to a sheer support pantyhose garment having an open-toe foot structure and an open crotch design which is suitable for wear while swimming, exercising or dancing. Variations on this design make it suitable for post-surgical or other medical uses.

BACKGROUND OF THE INVENTION

Many women are hesitant to wear bathing suits or summer shoe styles which require the wearer to remain bare-legged because they are ashamed of the appearance of their legs. Such women have a desire to improve the appearance of their legs so they can appear in public in a bathing suit, swim, wear sandals and abbreviated summer clothing with open shoes, and the like. The person may have visible varicose veins, unsightly scars, dimples or fatty deposits which render their legs unattractive and discourage them from appearing in a swimsuit. It is well known that wearing hosiery garments such as stockings or pantyhose improve the appearance of a woman's leg, and even women with attractive legs, including movie and television stars and dancers, wear hosiery garments such as pantyhose to make their legs appear sleek and attractive.

However, conventional hosiery garments, such as pantyhose and tights, include a hip portion, a pair of leg portions and a pair of foot portions which entirely enclose the feet. In normal use, these prior art garments are subject to increased wear at the toes where they may snag, run or tear. Reinforcement has the disadvantage of producing noticeable seams or yarns of different densities which detract from the appearance of the foot portion of such garments. See, for example, U.S. Pat. No. 3,711,866 to Vorberg which shows a panty hose garment having a reinforced heel and reinforced toes.

Conventional pantyhose, such as disclosed by Vorberg, are designed to be worn with traditional shoes which cover all or a substantial portion of the wearer's foot. Prior art pantyhose are not suitable for use when the wearer is swimming for a number of reasons. Pantyhose tend to stretch and bag when wet, hampering foot movement of a swimmer, as well as becoming uncomfortable and unsightly. Further, women who must wear pantyhose in order to be presentable in a bathing suit need a garment which is as unobtrusive and unobvious as possible, which remains in place during activity such as swimming, and which remains taut even when wet. A conventional pantyhose garment such as that taught by Vorberg is highly visible because of the reinforced areas of the foot portion, and does not provide the freedom of foot movement required during swimming as the foot portion tends to fill with water, stretch and hamper activity, and does not retain the required tension once wet to maintain the beneficial effect of wearing pantyhose. Sheer foot portions, while somewhat less noticeable, still suffer from the stretching problems when wet, tend to run easily, and as they encase the toes, make it apparent that the wearer has hosiery on under her bathing suit, and thus are also wholly unsuitable as a solution to this long standing problem. And in both cases, conventional foot portions of pantyhose are not suited for wear with sandals, particularly those having a thong arrangement as is common with beach and other summer footwear.

In addition, conventional pantyhose are difficult to pull up and down when they are wet. The pantyhose garment taught by Vorberg has a closed crotch design which necessitates their partial removal should the wearers need to relieve themselves during the period in which they are wearing the product. The present invention provides the wearer with an open crotch design which solves the problem of struggling with wet tights, as there is no need to remove them for purposes of elimination. This invention differs from that taught by Gollestani, and Southwell, U.S. Pat. Nos. 4,802,469 and 4,637,678 who use a flap or series of flaps for closure. The present invention has a round opening which is surrounded by a double knit band. When stretched on the body it forms a narrow slit which can be digitally manipulated when necessary.

Other prior art patents disclose arrangements where the wearer's toes and heels are exposed by providing one or more straps that extend downwardly from the ankles and under the bottom of the wearer's feet. Examples of such stirrup arrangements are disclosed in U.S. Pat. Nos. 856,066 to Lum; 1,435,047 to Blum; 3,670,339 to Cooper et al.; and 4,156,294 to Horn. These arrangements are disadvantageous for the present purpose because means are not provided for preventing the foot portion of the garment from being displaced rearwardly while the wearer is swimming, and the strap can detract from the appearance of the garment because it cannot be easily covered by thong shoes or open toe sandals. Thus, while the popular stirrup style exercise tights are suitable for use when worn with full shoes, or when worn in instances where the wearer will not be engaging in any water sport, and/or are not concerned with wearing a sheer garment with an unobtrusive foot portion, they are wholly unsuitable for use with a bathing suit.

U.S. Pat. Nos. 1,452,302 to Loren and 2,932,829 to Corbin disclose stockings that have one stall for the large toe and a separate stall for the four smaller toes. While such garments are marginally suitable for wear with sandals having a thong which fits between the large toe and the adjacent toe, they do not provide an unobtrusive foot portion, are not suitable for use while swimming, and do not retain a taut fit when wet. U.S. Pat. No. 1,798,201 to Hedges discloses a foot garment arrangement in which separate stalls are provided for the first, third and fifth toes only. These prior art garments are disadvantageous because they include toe portions which are not unobtrusive, are subject to increased wear from a functional standpoint, and are wholly objectionable from an aesthetic standpoint.

Similarly, U.S. Pat. No. 3,605,122 to Meyers shows a stocking in which the toes are exposed, but the foot portion is subject to rearward displacement when worn.

Payne U.S. Pat. No. 2,322,252 teaches an integral two piece shoe having a linear or "sock" which conforms to the shape of the exterior portion of the shoe. The liner, which is waterproof and cushioned, exposes the toes of the wearer and provides a bight at the lower end of the wearer's foot so as to fit between the first and second toes and position the liner within the shoe. Because of the shoe component mating with the sock, the provision of cushioning under the ball of the foot, and the general objectives of Payne, it does not solve nor suggest a solution to the longstanding problem of providing a comfortable pantyhose garment which can be worn while swimming. A single thong between the first and second toes puts extreme pressure on the foot while swimming or exercising, causing pain between the toes and on the bottom of the foot.

The present invention, which departs from the teaching of Payne, provides a double thong which is worn between the first and second toes, and between the fourth and fifth toes. This arrangement significantly reduces the stress on the foot because the tension is spread over the entire toe portion. The current design also differs from Hearn, U.S. Pat. No. 1,999,929, whose open toe design provides straps encasing the lower portion of the foot and going between every toe. This design is not only unsightly for use with swimwear, but it also fails to take into account the structural differences between the toes, ie, the fact that a slight "webbing" exists between the third and fourth toes. Forcing all of the toes into stalls of the same height may cause discomfort to the wearer.

The open toe-open crotch design is also beneficial when using this garment for exercise. People who are tennis players, or who are dancers for example, and who wish to wear a pantyhose garment for aesthetic reasons can wear this product because the toes are not constricted as they would be if wearing conventional panty hose. Current styles in dance footwear feature open toe and thong toe slippers. Conventional stirrup pantyhose or tights are aesthetically unpleasing when worn with this type of shoe. Also the open crotch design provides ventilation and helps prevent the build up of perspiration and odors which occur during strenuous exercise.

A variation of this design could be useful for post surgical patients who have undergone plastic surgery for liposuction or removal of veins, or other types of surgery which require the patient to constantly wear a supportive panty for a specified period of time. This invention differs from Gollestani, U.S. Pat. No. 4,802,469, in that claims are made for a therapeutic body suit which does not have leg portions, and features an open crotch design which consists of a removable flap.

Thus the present garment provides a solution to the longstanding need for an unobtrusive, comfortable hosiery garment which can be worn by women with less than perfect legs while swimming or engaging in exercise, sports or dance, as well as by post surgery patients.

SUMMARY OF THE INVENTION

The foregoing disadvantages of the prior art are overcome in accordance with the present invention which provides a comfortable hosiery garment having an convenient open crotch design and an open-toe, unobtrusive foot structure which not only allows the wearer greater freedom and less drag while swimming, but maintains the pantyhose taut and in place even when wet.

It is a feature of the present invention that the hosiery garment looks natural and is not noticeable and can be worn under a bathing suit or other abbreviated clothing article where the wearer is likely to be barefoot or wear sandals or shoes requiring bare toes for a natural look. It is composed of sheer and relatively unnoticeable fabric and may be skin toned to blend into the exposed portions of the wearer's feet. The hosiery garment will effectively slenderize the appearance of the wearer's legs, substantially covering unsightly scars, veins and dimples, while remaining relatively unobtrusive in use, and allowing the wearer to engage in water sports, exercise and dance. The thong-type of fit at the toes improves the fit of the garment while extending its useful life by overcoming the problems of wear at the toe portion.

The open crotch design is one which provides convenience by eliminating the need to remove the garment while it is wet. It also provides ventilation when the wearer is engaged in exercise, and lastly, it is useful for post surgical patients who must wear a panty or pantyhose product for several days without removing it. removing it.

BRIEF DESCRIPTION OF THE DRAWING

The present invention will be more fully understood when considered in view of the following description and drawings in which.

DETAILED DESCRIPTION OF THE PREFERRED EMBODIMENTS

Figure 1:
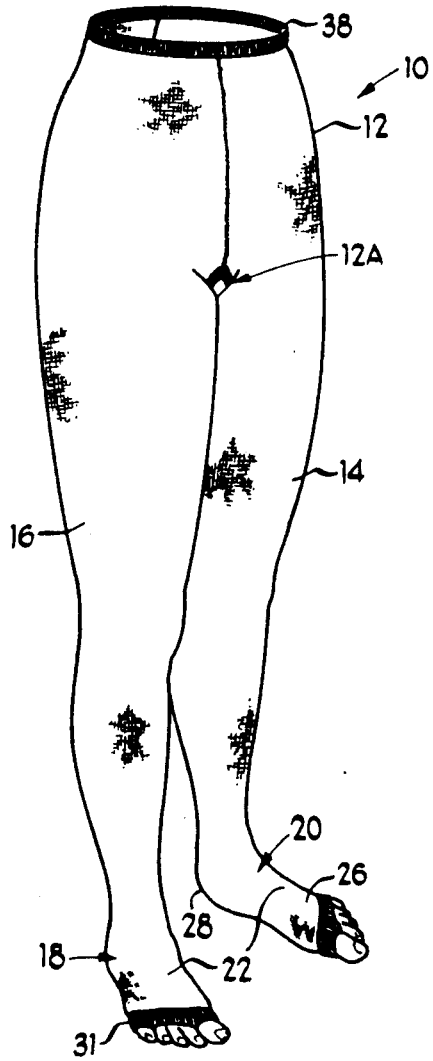
FIG. 1 is a three quarter elevational view of the hosiery garment of the present invention on the hips, legs and feet of a wearer.

Referring to the drawings, FIG. 1 shows the pantyhose garment 10 of the present invention positioned on the legs and feet of a wearer. The novel foot portion of pantyhose 10 maintains the tautness in the foot and leg portions of the natural and more comfortable foot design than can be obtained with prior art and further permits the user to wear a wide variety of open-toe shoe styles without it being apparent that hosiery are being worn. Pantyhose 10 is particularly suited for use when worn with a bathing suit or other sports wear or dance costumes by women who would otherwise be reluctant to enjoy their activities because of the appearance of their legs. In addition to helping to hide veins and cellulite, this garment provides support in both the leg and hip portions of the body.

The open crotch design 12 A not only offers convenience for the wearer, but also has practical applications for those doing strenuous exercise and for post surgery patients who require a tightly fitted open crotch garment.

In accordance with this invention, the pantyhose garment 10 has hip engaging portions 12, an open crotch 12 A, a pair of leg engaging portions 14 and 16, and a pair of foot engaging portions 18 and 20. Each of the leg engaging portions 14 and 16 are positioned intermediate the hip portion 12 and one of the foot portions 18 and 20. The hip engaging portion and the leg engaging portions are constructed of sheer and relatively unnoticeable fabric.

Figure 2:
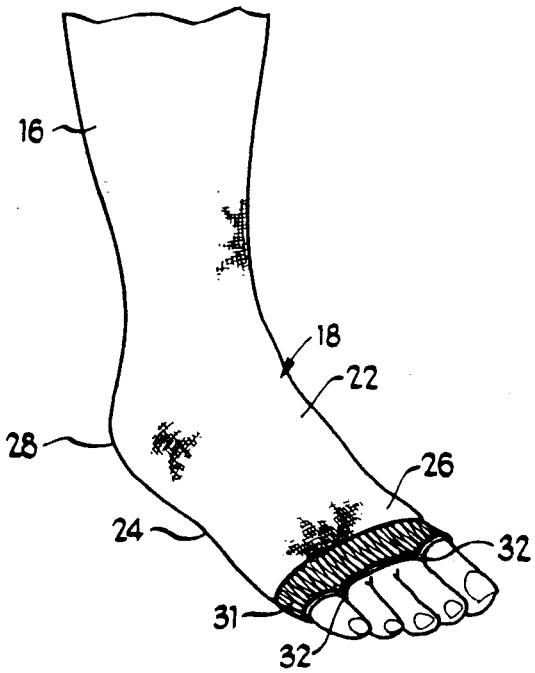
FIG. 2 is an elevational perspective view of an embodiment of the foot portion of the pantyhose garment on a wearer.

As shown in FIGS. 1 and 2, each of the foot portions has a top wall 22, bottom wall 24, front end 26, and back end 28. It is a feature of the invention that the foot portion 18 is cut away at the front end 26 and terminates in forward edge 30 which is spaced rearwardly from the base of the wearer's toes. Accordingly, all five of the wearer's toes extend through the front end of the foot portion and are exposed in use.

A 1" wide stretchable band 31 that is suitably formed of a double knit fabric or other material of similar strength and stretchability can be secured to, and is preferable woven around, the foot portion about the forward edge 30, for the purpose of providing an improved fit of the front end 26 of the garment about the wearer's foot, and, in conjunction with strap means 32, holding the foot portion in place during swimming or other activity and maintaining the foot and leg portions of the pantyhose taut on the wearer's legs and feet.

Strap means 32, preferably in the form of a thong, is created by bar tacking the upper portion of the band to the lower portion. That is it extends forwardly from the forward edge 30 of the top wall 22 of the foot portion and the forward edge 30 of the bottom wall 24. On bottom wall 24 is a continuation of the double fabric band on top wall 22. The strap means 32 thereby connects the top and bottom walls at the front end 26 of the foot portion and cooperates with the wall at the front end 26 to form a toe aperture 1¼ inch from outer wall 36 and another toe aperture 1¼ in from inner wall 34, thus creating three aperture.

Figure 3:
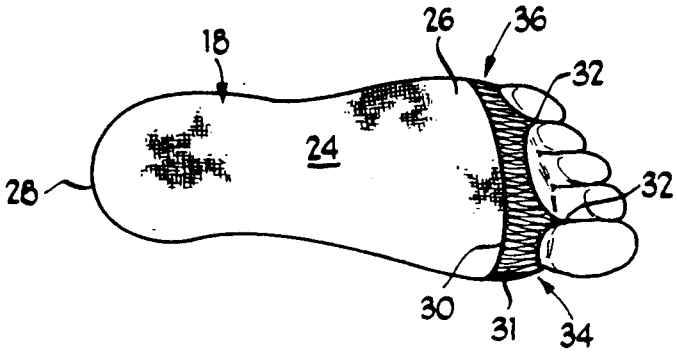
FIG. 3 is a bottom plan view of the foot portion of the hosiery garment on a wearer.
Figure 5:
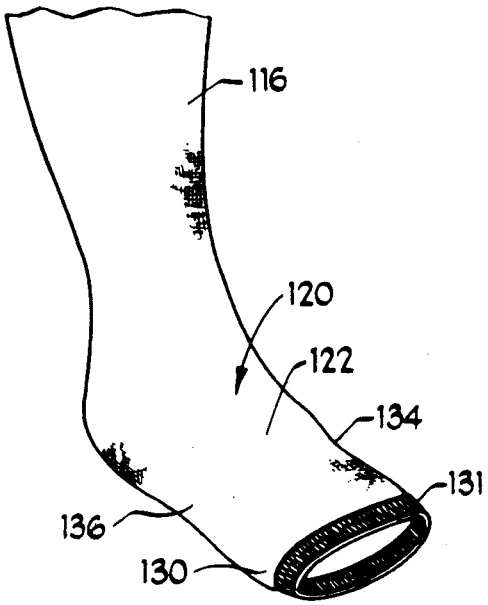
FIG. 5 is an elevational perspective view of the foot portion of a knitted blank of the pantyhose garment of this invention having an open and unfinished foot portion.
Figure 6:
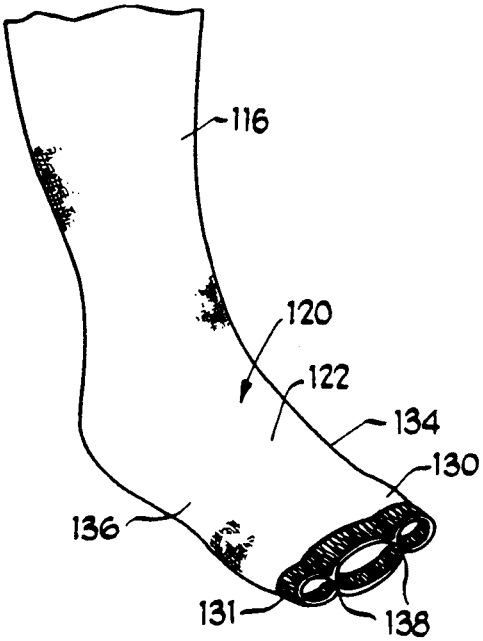
FIG. 6 is an elevational view of the foot portion of the garment having the front end finished to provide a double thong having a toe aperture adjacent each of its sides.

Referring to FIG. 3, the foot portion also has an inner side wall 34 on the inside of the foot, and an outer side wall 36 on the opposite side of the foot is connected to top wall 22 and the bottom wall 24 1¼ inches from the inner side wall 34 and connected to the top wall 22 and the bottom wall 24 1¼ from the outer side wall 36 such that the strap means 32 will be received between the first and second toes of the wearer, and between the fourth and fifth toes of the wearer in a thong-type arrangement, as shown in FIGS. 1 and 2. The strap means is integral with the foot portion 20. FIGS. 5 and 6 illustrate hosiery blanks to further clarify this procedure. The strap means facilitates a firm and secure fit of the hosiery garment on the foot of the wearer. It also serves to anchor and stabilize the garment along the ankle, leg and knee portions of the pantyhose which is an important feature of this invention, since it is critical to maintain the pantyhose taut even when wet to provide a natural look and not call attention to the fact that pantyhose are being worn. The strap is between the wearer's first and second toes and between the forth and fifth toes so as to spread the tension created by a thong arrangement. The straps also functions as a stop means to prevent the foot portion from moving rearwardly toward the heel as do the stirrup arrangements which expose the heel and toe portion of the foot, and which results in the garment riding up on the leg of the wearer. The open front end of the foot portion also extends the useful life of the hosiery results in the garment riding up on the leg of the wearer. The open front end of the foot portion also extends the useful life of the hosiery garment since the toe portion of a garment is frequently one of the first portions to tear or become worn. When used for exercising or dancing it prevents the cramping frequently caused by conventional panty hose with a closed toe design.

Figure 4:
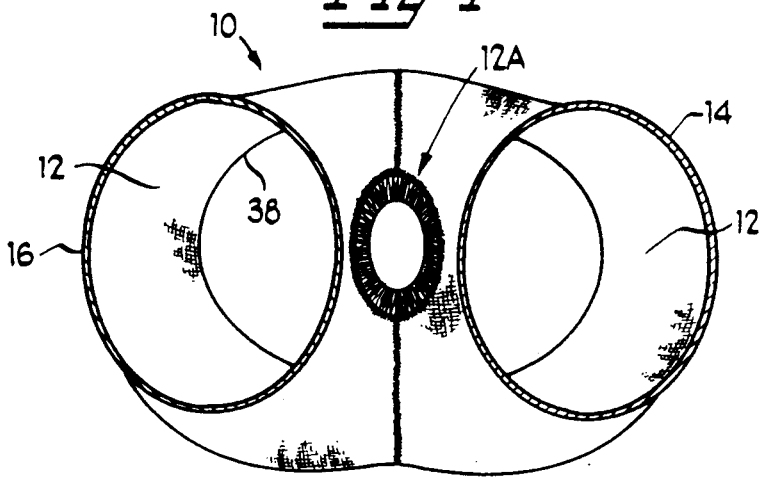
FIG. 4 is an enlarged cross sectional view of the open crotch design as it is attached to the hip engaging portion and the leg engaging portions.

FIG. 4, an enlarged cross sectional view showing how the circular double knit band 12 A connects to the front and rear panels of the hip engaging portions 12, and the leg engaging portions 14 and 16.

A second aspect of the invention concerns methods of manufacturing the open-toe pantyhose of the present invention, depicted by FIGS. 5, and 6, and described in the discussion of FIG. 3.

Referring to these Figures, three digit numbers in the one hundred series are used to refer to various elements. The same last two digits in each numeral designates a comparable element in the embodiments as set forth in FIGS. 1–4.

In FIG. 5, leg engaging portions 114 and foot engaging portions 120 of hosiery garment or pantyhose 110 are shown in knitted, complete form with open, unfinished forward edge 130. Top wall 122, outer side wall 136 and inner side wall 134 lay behind the front end which is defined by the periphery of edge 130 of the foot section. The periphery is configured horizontally in line with the toe alignment of the wearer of the finished 120 of the assembly, as described in the discussion of FIG. 3. The strap means 132 is connected to the top wall 122 and the bottom wall 124 1¼ inches from the inner side wall 134 and connected to the top wall 122 and the bottom wall 124 1¼ inches from the outer side wall 136 such that the strap means 132 will be received between the first and second toes of the wearer, and between the fourth and fifth toes of the wearer in a thong-type arrangement, as shown in FIGS. 1 and 2. The strap means is integral with the foot portion 120.

The hosiery garment, with the exception of the finishing of the novel foot portion, can be made by conventional methods of manufacture such as the methods disclosed in U.S. Pat. Nos. 3,449,932 to Fillmore et al.; 3,711,866 to Vorberg; 3,777,681 to Horita; and 3,808,842 to Fisher et al., which are incorporated by reference.

While there may be other variations and combinations, this hosiery garment is composed of double knit fabric consisting of 24.3 percent Lycra, and 25.7 percent Nylon. It is 20 denier covered with 15/7. This extremely durable, yet sheer support garment is knit on an Alta Veloce knitting machine using #402 needle.

The preferred method of manufacturing the pantyhose is as follows. The pantyhose with hip, leg and foot engaging portions is knitted and formed in the usual manner with the foot portions having unfinished, open forward edges. These open foot edges are encased by a 1 inch thick double knit band to thereby finish and reinforce them. A sector of the hemmed open end is then bar tacked in two places to join the top wall and the bottom wall of the foot portions, resulting in formation of strap means which is placed between the first and second toes, and the forth and fifth toes when worn.

The pantyhose of the present invention is comprised of sheer, relatively unnoticeable fabric and has seamless leg engaging portions. In accordance with the present invention, the hosiery garment can be worn under a bathing suit or other clothing which exposes the wearer's legs and feet. This supportive hosiery garment, being sheer, is barely noticeable and effectively slenderizes the appearance of the wearer's legs, while substantially covering scars, veins, dimples, and the like that detract from a desired appearance.

If desired, however, a pattern which coordinates with the wearer's swim suit or exercise/dance costumes, may be incorporated into the fabric for purposes of style and aesthetics without departing from the spirit and scope of the invention.

From the foregoing, it will be observed that numerous variations and modifications may be effected without departing from the true spirit and scope of the novel concept of this invention. It is, of course, intended to cover by this invention, all such variations and modifications which fall within the scope of the appended.

I claim:

1. An open-toed pantyhose garment for wear with swimsuits, exercise and dancewear and post-surgical wear that entirely covers the lower body of a wearer having a top section with an open crotch and two leg portions wherein each leg portion has a foot portion having an edge that encircles the wearer's foot and defines an opening through which the wearer's toes protrude, each circular edge having an upper portion and a lower portion wherein the upper portion is adjacent the top of the wearer's foot and the lower portion is adjacent the bottom of the wearer's foot, said edge being bridged by strap means between the first and second toes and the fourth and fifth toes wherein the strap means hold the pantyhose securely in place at the toe end.

2. The pantyhose garment according to claim 1, wherein the material of the pantyhose is sufficiently sheer and fleshtoned to give the appearance of natural skin while being sufficiently opaque to hide blemishes.

3. An open-toed pantyhose garment according to claim 1 wherein said strap means are ⅛ inch wide.

4. An open-toed pantyhose garment according to claim 1 wherein said strap means have two ends, one end secured to said top portion edge and the opposite end secured to said bottom portion edge of said foot portion.

5. An open-toed pantyhose garment according to claim 1 wherein a stretchable band is secured to said foot portion along the forward edge thereof.

6. An open-toed pantyhose garment according to claim 1 wherein a double knit band ½ inch wide encircles the crotch portion of the top section.

7. An open-toed pantyhose garment according to claim 6 wherein the double knit band stretches to form a narrow slit open crotch design.

8. An open-toed pantyhose garment having a ventilated crotch portion wherein said pantyhose is contructed of substantially sheer fabric comprising a hip engaging portion having an upper edge having a stretchable knit band to encircle the waist of the wearer and a lower edge connected to a pair leg engaging portions each having an open toe foot portion having a bottom wall, top wall, front end, back end, inner side wall and outer side wall wherein the foot portion is cut away at the front end providing an edge having a stretchable knit band attached to the top wall, bottom wall and the inner and outer side walls of the foot portion to encircle the foot near the base of the toes defining and opening through which the toes protrude wherein the top wall and the bottom wall portions of the edge are bridged between the first and second and the fourth and fifth toes by straps.

9. The pantyhose garment of claim 8 wherein said crotch portion is a double knit band being integral with said hip engaging portion.

10. The pantyhose of claim 8 wherein said straps are integral with the foot portions.

11. The pantyhose garment of claim 8 wherein said straps are formed by bar tacking the upper wall to the bottom wall.

12. The pantyhose of claim 8 wherein said strap has one end secured to said bottom wall of said foot portion.

13. An open-toed pantyhose according to claim 8 wherein the stretchable knit band of the foot portion is one inch wide.

14. An open-toed pantyhose according to claim 8 wherein the stretchable knit band on the upper edge of the hip engaging portion is one inch wide.

* * * * *